US011344991B2

(12) United States Patent
Nagengast et al.

(10) Patent No.: US 11,344,991 B2
(45) Date of Patent: May 31, 2022

(54) RETAINER FOR CHEMICAL MECHANICAL POLISHING CARRIER HEAD

(71) Applicant: Applied Materials, Inc., Santa Clara, CA (US)

(72) Inventors: Andrew J. Nagengast, Sunnyvale, CA (US); Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 100 days.

(21) Appl. No.: 16/799,688

(22) Filed: Feb. 24, 2020

(65) Prior Publication Data

US 2020/0276686 A1 Sep. 3, 2020

Related U.S. Application Data

(60) Provisional application No. 62/812,164, filed on Feb. 28, 2019.

(51) Int. Cl.
*B24B 37/32* (2012.01)

(52) U.S. Cl.
CPC ..... *B24B 37/32* (2013.01)

(58) Field of Classification Search
CPC ..... B24B 37/32; B24B 37/30
USPC ..... 451/398
See application file for complete search history.

(56) References Cited

U.S. PATENT DOCUMENTS 6,024,630 A * 2/2000 Shendon ..... B24B 37/30 451/41
6,251,215 B1 6/2001 Zuniga et al.
6,443,823 B1 * 9/2002 Tolles ..... B24B 37/30 451/288
7,121,934 B2 10/2006 Jung
(Continued)

FOREIGN PATENT DOCUMENTS

EP 0881039 12/1998
JP 2005-169527 6/2005
(Continued)

OTHER PUBLICATIONS

PCT International Search Report and Written Opinion in International Appln. No. PCT/US2020/019432, dated Jun. 19, 2020, 13 pages.

*Primary Examiner* — Joseph J Hail
*Assistant Examiner* — Robert C Moore
(74) *Attorney, Agent, or Firm* — Fish & Richardson P.C.

(57) ABSTRACT

A carrier head for chemical mechanical polishing includes a base, an actuator, a substrate mounting surface, and a retainer. The retainer includes an inner section and an outer section connected by a flexure. A bottom of the inner section of the retainer provides an inner portion of a lower surface configured to contact a polishing pad. An inner surface of the inner section extends upwardly from an inner edge of the lower surface to circumferentially surround the substrate mounting surface. The inner section of the retainer is positioned to receive a controllable load from the actuator and is vertically movable relative to the base. A bottom of the outer section of the retainer provides an outer portion of the lower surface. The outer section of the retainer is vertically fixed to the base. The inner section of the retainer is vertically movable relative to the outer section of the retainer.

15 Claims, 2 Drawing Sheets

(56) References Cited

U.S. PATENT DOCUMENTS

| | | | |
|---|---|---|---|
| 7,883,397 | B2 | 2/2011 | Zuniga et al. |
| 10,022,837 | B2 | 7/2018 | Chen et al. |
| 2008/0119120 | A1 | 5/2008 | Zuniga et al. |
| 2012/0034849 | A1 | 2/2012 | Chen et al. |

FOREIGN PATENT DOCUMENTS

| | | |
|---|---|---|
| JP | 2017-209757 | 11/2017 |
| KR | 10-2012-0012099 | 2/2012 |

* cited by examiner

RETAINER FOR CHEMICAL MECHANICAL POLISHING CARRIER HEAD

CROSS-REFERENCE TO RELATED APPLICATIONS

This application claims priority to U.S. Application Ser. No. 62/812,164, filed on Feb. 28, 2019, the disclosure of which is incorporated by reference.

TECHNICAL FIELD

The present disclosure relates to a retainer for use in chemical mechanical polishing of substrates.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

The carrier head provides a controllable load on the substrate to push it against the polishing pad. A retaining ring is used to hold the substrate in place below the carrier head during polishing. Some carrier heads include both an inner ring to retain the substrate and an outer ring which surrounds the inner ring.

SUMMARY

In one aspect, a carrier head for chemical mechanical polishing includes a base, an actuator, a substrate mounting surface, and a retainer. The retainer has an inner section and an outer section connected by a flexure such that the inner section of the retainer is vertically movable relative to the outer section of the retainer. A bottom of the inner section of the retainer provides an inner portion of a lower surface configured to contact a polishing pad, and an inner surface of the inner section extends upwardly from an inner edge of the lower surface to circumferentially surround the substrate mounting surface. The inner section of the retainer is positioned to receive a controllable load from the actuator and is vertically movable relative to the base. A bottom of the outer section of the retainer provides an outer portion of the lower surface, and the outer section of the retainer is vertically fixed to the base.

In another aspect, a retaining ring includes an inner section, and outer section, and a flexure coupling the inner section and the outer section such that the inner section is vertically movable relative to the outer section. The inner section has a bottom that provides an inner portion of a lower surface of the retainer configured to contact a polishing pad, and has an inner surface extending upwardly from an inner edge of the lower surface and configured to circumferentially surround a substrate mounting surface. The outer section has a bottom that provides an outer portion of the lower surface, and has an outer surface extending upwardly from an outer edge of the lower surface.

Implementations may include one or more of the following features.

The actuator may include a pressurizable chamber. For example, the actuator may include a membrane and the inner section may be secured to the membrane.

The flexure may be thinner than the inner section and the outer section. The flexure may be positioned adjacent to the bottom of the inner section and the outer section. The bottom of the flexure may provide a middle portion of the lower surface. The inner portion of the lower surface and the outer portion of the lower surface may be coplanar when the when the flexure is not being flexed. The middle portion of the lower surface may be coplanar with the inner portion and outer portion of the lower surface when the flexure is not being flexed.

The flexure may be composed of the same material as the inner section and the outer section. The retainer may be a single unitary body of homogenous composition. The inner section may be narrower and/or taller than the outer section.

Implementations may optionally include, but are not limited to, one or more of the following advantages. Polishing non-uniformity, e.g., caused by a polishing head profile issue at a substrate edge, can be reduced. Defects can be reduced, e.g., without sacrificing ability to adjust the polishing rate at the substrate edge.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

As noted above, some carrier heads include both an inner ring to retain the substrate and an outer ring which surrounds the inner ring. It is possible for slurry or other particulates to become trapped in the space between the inner ring and outer ring, resulting in defects, e.g., scratching, of the substrate being polished. However, an assembly in which the inner ring and outer ring are joined together by a flexible part can reduced these problems.

Figure 1:
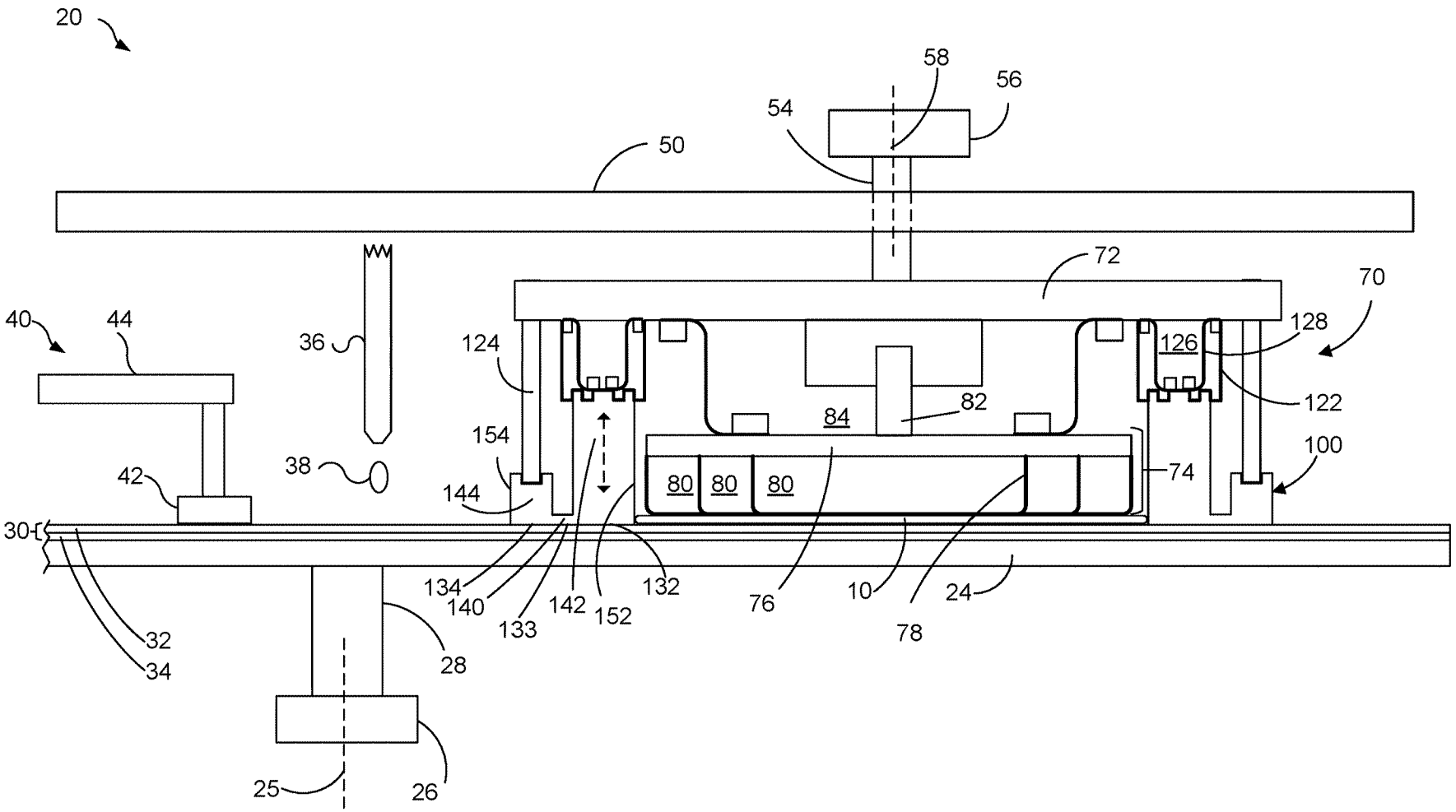
FIG. 1 shows a cross-sectional view of a carrier head in a chemical mechanical polishing system.

FIG. 1 illustrates an example of a polishing station of a chemical mechanical polishing system 20. The polishing system 20 includes a rotatable disk-shaped platen 24 on which a polishing pad 30 is situated. The platen 24 is operable to rotate about an axis 25. For example, a motor 26 can turn a drive shaft 28 to rotate the platen 24. The polishing pad 30 can be a two-layer polishing pad with an outer polishing layer 32 and a softer backing layer 34.

The polishing system 20 can include a supply port or a combined supply-rinse arm 36 to dispense a polishing liquid 38, such as an abrasive slurry, onto the polishing pad 30. The polishing system 20 can include a pad conditioner apparatus 40 with a conditioning disk 42 to maintain the surface roughness of the polishing pad 30. The conditioning disk 42 can be positioned at the end of an arm 44 that can swing so as to sweep the disk 42 radially across the polishing pad 30.

A carrier head 70 is operable to hold a substrate 10 against the polishing pad 30. The carrier head 70 is suspended from a support structure 50, e.g., a carousel or a track, and is connected by a drive shaft 54 to a carrier head rotation motor 56 so that the carrier head can rotate about an axis 58. Optionally, the carrier head 70 can oscillate laterally, e.g., on sliders on the carousel, by movement along the track, or by rotational oscillation of the carousel itself.

The carrier head 70 includes a housing 72, a substrate backing assembly 74 which includes a base 76 and a flexible membrane 78 that defines a plurality of pressurizable chambers 80, a gimbal mechanism 82 (which may be considered part of the assembly 74), a loading chamber 84, a retaining ring assembly 100, and an actuator 122.

The housing 72 can generally be circular in shape and can be connected to the drive shaft 54 to rotate therewith during polishing. There may be passages (not illustrated) extending through the housing 72 for pneumatic control of the carrier head 100. The substrate backing assembly 74 is a vertically movable assembly located beneath the housing 72. The gimbal mechanism 82 permits the base 76 to gimbal relative to the housing 72 while preventing lateral motion of the base 76 relative to the housing 72. The loading chamber 84 is located between the housing 72 and the base 76 to apply a load, i.e., a downward pressure or weight, to the base 76 and thus to the substrate backing assembly. The vertical position of the substrate backing assembly 74 relative to a polishing pad is also controlled by the loading chamber 84. The lower surface of the flexible membrane 78 provides a mounting surface for a substrate 10.

In some implementation, the substrate backing assembly 74 is not a separate component that is movable relative to the housing 72. In this case, the chamber 84 and gimbal 82 are unnecessary.

Figure 2:
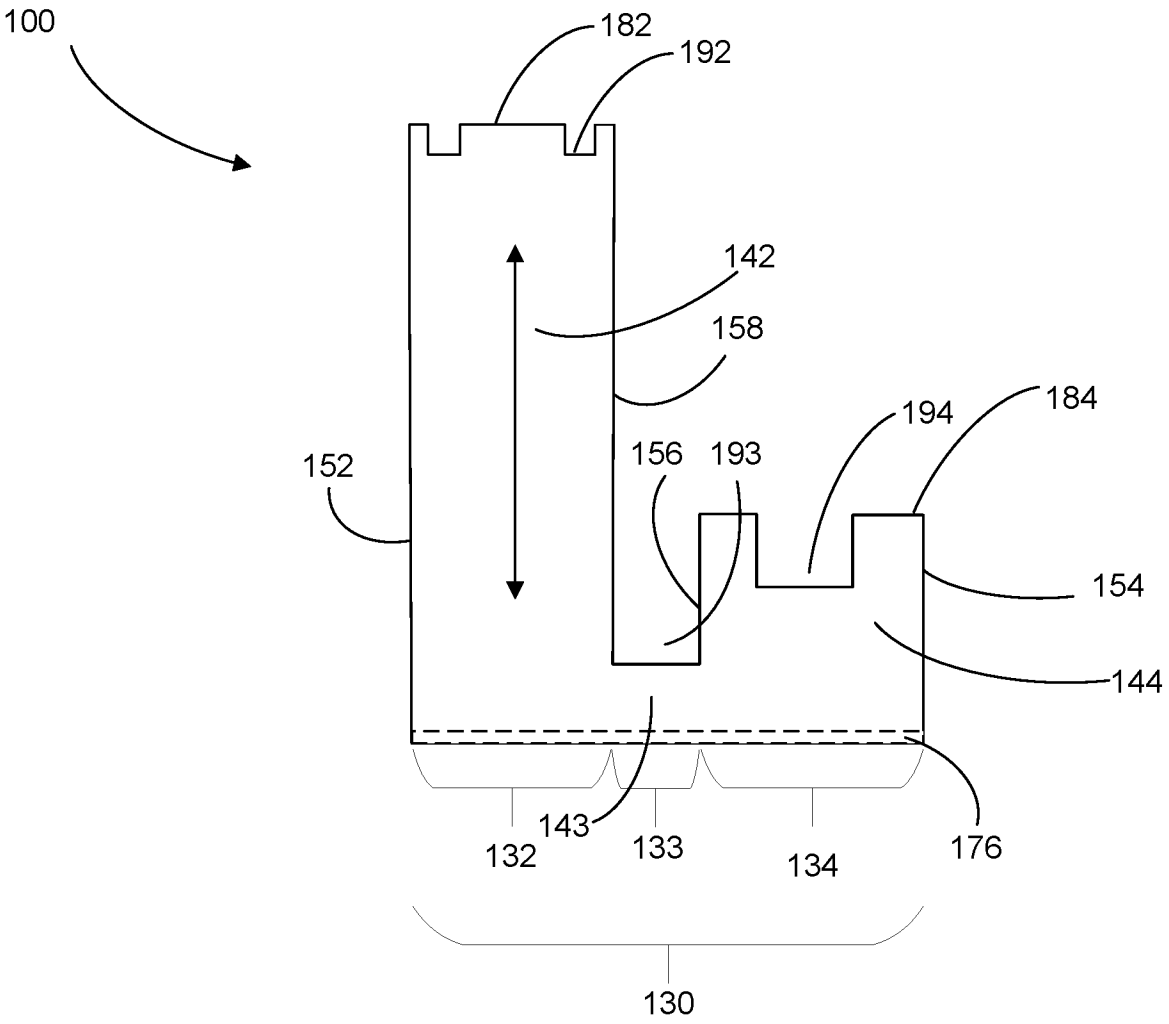
FIG. 2 shows a cross-sectional view of a portion of a retainer.

Referring now to FIGS. 1 and 2, the retainer 100 has an outer section 144, an inner section 142, and a flexure 143 connecting the outer section 144 to the inner section 142. A lower surface 130 of the retainer 100 can contact the polishing pad 30.

The outer section 144 is vertically fixed relative to the housing 72, and is an annular body that provides positioning or referencing of the carrier head 70 to the surface of the polishing pad 30. In addition, the outer section 144 provides lateral referencing of the retainer 100, e.g., the inner section 142 of the retainer, against the polishing pad 30. The outer section 144 circumferentially surrounds the inner section 142.

The bottom of the outer section 144 provides an outer portion 134 of the lower surface 130. The outer section 144 has an outer surface 154, which can be a vertically cylindrical surface. The outer surface 154 can extend upwardly from an outer edge of the lower surface 130. The outer section 144 also has an inner surface 154, which can be a vertically cylindrical surface. The inner surface 154 extends from an annular upper surface 184 of the outer section 144 to the top surface of the flexure 143.

The outer section 144 can be secured to the housing 72, for example, by an adhesive, a fastener, or by interlocking parts. For example, the upper surface 184 of the outer section 144 can include cylindrical recesses or holes 194 with screw sheaths (not shown) to receive fasteners, such as bolts, screws, or other hardware. For example, a fastener 124, such as a screw or bolt, can extend through the housing 72 to secure the outer section 144 of the retainer 100 to the housing 72.

The inner section 142 is an annular body that is vertically movable relative to the housing 72. The inner section 142 has an inner surface 152 that is configured to circumferentially surround the edge of the substrate 10 to retain the substrate 10 in the carrier head during polishing. The inner surface 152 can extend upwardly from an inner edge of the lower surface 130 to an annular top surface 182 of the inner section 142. The bottom of the inner section 142 provides an inner portion 132 of the lower surface 130. The inner section 142 also has an outer surface 158, which can be a vertically cylindrical surface. The outer surface 158 extends from the upper surface 182 of the inner section 142 to the top surface of the flexure 143

The material composing the inner section 142 is the same as the material composing the outer section 144. In some implementations, the inner section 142 and the outer section 144 can be composed of different materials, but with similar compressibility and tensile modulus. The material composing the inner section 142 should not be so compressible that downward pressure on the inner section 142 causes the inner section 142 to extrude into the substrate receiving recess.

Alternatively, in some implementations the inner section 142 and the outer section 144 can be composed of substantially the same material but with different densities (e.g., the inner section 142 is less dense, more compressible, and more flexible than outer section 144). In some implementations, the inner section 142 and the outer section 144 can be composed of different materials (e.g., where the inner section 142 is composed of a more compressible and flexible material than the outer section 144). The outer section 144 can be formed of a material that is more rigid than the inner section 142.

The inner section 142 is vertically movable relative to the outer section 144, and can be movable when acted upon by the actuator 122. The actuator 122 can be secured to the top surface 182 of the inner section 142 by interlocking parts, by an adhesive, or by a fastener. The top surface 182 of the inner section 142 of the retainer 100 can include cylindrical recesses or holes 192 with screw sheaths (not shown) to receive fasteners, such as bolts, screws, or other hardware, for securing the inner section 142 to the actuator 122.

The inner section 142 is narrower than the outer section 144. Alternatively, the inner section 142 can be the same width as the outer section 144, or the inner section 142 can be wider than the outer section 144. However, having the inner section 142 be narrower can provide superior control of the polishing rate near the substrate edge, as the compression of the polishing pad by the outer section 144 can also be used as a control parameter.

In some implementations, the actuator 122 is secured to the housing 72. The actuator 122 can be, for example, a pressurizable chamber, a piston, or a similar mechanical or electromechanical apparatus capable of vertically moving the inner section 142. For example, the actuator 122 can be provided by an inflatable membrane 128 that encloses a pressurizable chamber 126. For example, the membrane 128 enclosing the pressurizable chamber 126 can be secured to the inner section 142 when the pressurizable chamber 126 expands to interlock with the recesses or holes 192 of the top surface 182 of the inner section 142. In another example, a fastener such as a screw or bolt extends through the membrane 128 to clamp to the recess or hole 192. The actuator 122 can apply a controllable downward force to the inner section 142 of the retainer 100.

If the actuator 122 decreases the force it applies on the inner section 142, the pressure applied to the polishing pad 30 near the edge of the substrate 10 also decreases. On the other hand, if the actuator 122 increases the force it applies on the inner section 142, the pressure applied to the polishing pad 30 near the edge of the substrate 10 also increases. Control of degree of compression of the polishing pad near the substrate edge can permit the rate of polishing near the edge of the substrate 10 to be controlled.

The inner section 142 and the outer section 144 are connected by a flexure 143. The bottom of the flexure 143 provides a middle portion 133 of the lower surface 130. The top surface 183 of the flexure is recessed below the top surface 182 of the inner section 142 and the top surface 184 of the outer section 144. The flexure 143 can be composed of the same material as the inner section 142 and the outer section 144. Alternatively, in some implementations the flexure 143 is composed of a material that is similar to, different from, or a mix of the materials composing the inner section 142 and the outer section 144. In some implementations, the retainer 100 is a single unitary body (i.e., no discontinuities caused by adhesive, gaps between joined sections, etc.) of homogenous composition.

The flexure 143 is substantially strong enough (e.g., composed of a strong enough material and/or thick enough) to join the inner section 142 to the outer section 144 while still being flexible enough to allow the inner section 142 to be vertically movable relative to the outer section 144 when the actuator 122 applies force to the inner section 142. For example, if the actuator 122 applies a force down on the inner section 142, the flexure 143 can hingedly "flex" so that the inner section 142 moves vertically relative to the outer section 144, while still being secured to the outer section 144 by the flexure 143.

The flexure 143 can be thin enough to hingedly flex while still securing the inner section 142 and the outer section 144. For example, the flexure 143 can be thin relative to the inner section 142 and the outer section 144.

The lower surface 130 of the retainer 100 includes the inner portion 132, the middle portion 133 and the outer portion 134. The lower surface 130 can be brought into contact with the polishing pad 30. The flexure 143 can be positioned so that the middle portion 133 of the lower surface 130 is generally aligned with the inner portion 132 and outer portion 134 of the lower surface 130. For example, the inner portion 132, the middle portion 133 and the outer portion 134 can all be coplanar (when the actuator is not applying a downward force to the inner portion 132).

The lower surface 130 can be formed of a material which is chemically inert in a CMP process, such as a plastic, e.g., polyphenylene sulfide (PPS). The lower surface 130 should also be durable and have a low wear rate. The lower surface 130 can be a smooth and wearable surface, as the lower surface 130 is not configured to abrade the polishing pad 30.

An advantage to having the flexure 143 connecting the inner section 142 and the outer section 144 is that there is no gap between the inner section 142 and the outer section 144 along the bottom surface 130. Thus, the likelihood of slurry being trapped is reduced and defects can be reduced. In addition, because the middle portion 133 of the lower surface 130 can directly contacts the polishing pad 30, irregularities in pad compression can be avoided, which can help improve polishing consistency.

In some implementations, the retainer 100 has one or more channels 176 formed in the lower surface 130. The channels 176 extend from the inner diameter to the outer diameter of the retainer 100 to allow slurry to pass from the exterior to the interior of the inner ring during polishing, and to allow for draining of excess slurry and polishing by-products. The channels 176 can be evenly spaced around the retainer 100. Each channel 176 can be offset at an angle, e.g., 45°, relative to the radius passing through the channel 176. The channels 176 can have a width of about 0.125 inches.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The above described polishing system and methods can be applied in a variety of polishing systems. Either the polishing pad, or the carrier head, or both can move to provide relative motion between the polishing surface and the substrate. The polishing pad can be a circular (or some other shape) pad secured to the platen. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims. For example, the actions recited in the claims can be performed in a different order and still achieve desirable results.

What is claimed is:

1. A carrier head for chemical mechanical polishing, comprising:

a base;

an actuator;

a substrate mounting surface; and a retainer having an inner section and an outer section connected by a horizontal flexure that spans an entire gap between the inner section and the outer section such that the inner section of the retainer is vertically movable relative to the outer section of the retainer, wherein a bottom of the inner section of the retainer provides an inner portion of a lower surface configured to contact a polishing pad, and wherein an inner surface of the inner section extends upwardly from an inner edge of the lower surface to circumferentially surround the substrate mounting surface, wherein the inner section of the retainer is positioned to receive a controllable load from the actuator and is vertically movable relative to the base, wherein a bottom of the outer section of the retainer provides an outer portion of the lower surface, wherein the outer section of the retainer is vertically fixed to the base, wherein a bottom of the flexure provides a middle portion of the lower surface positioned between the inner portion and the outer portion of the lower surface and the middle portion is coplanar with the inner portion and the outer portion of the lower surface when the flexure is not being flexed.

2. The carrier head of claim 1, wherein the actuator comprises a pressurizable chamber.

3. The carrier head of claim 2, wherein the actuator comprises a membrane that encloses the pressurizable chamber and the inner section is secured to the membrane.

4. The carrier head of claim 1, wherein the flexure is thinner than the inner section and the outer section.

5. The carrier head of claim 1, wherein the inner section is taller than the outer section.

6. The carrier head of claim 1, wherein the inner section is narrower than the outer section.

7. The carrier head of claim 1, wherein the inner portion of the lower surface and the outer portion of the lower surface are coplanar when the when the flexure is not being flexed.

8. A retaining ring, comprising:

an inner section having a bottom that provides an inner portion of a lower surface of the retaining ring configured to contact a polishing pad, the inner section further having an inner surface extending upwardly from an inner edge of the lower surface and configured to circumferentially surround a substrate mounting surface;

an outer section having a bottom that provides an outer portion of the lower surface, the outer section further having an outer surface extending upwardly from an outer edge of the lower surface; and a horizontal flexure that spans an entire gap between the inner section and the outer section and coupling the inner section and the outer section such that the inner section is vertically movable relative to the outer section, wherein a bottom of the flexure provides a middle portion of the lower surface positioned between the inner portion and the outer portion of the lower surface and the middle portion is coplanar with the inner portion and the outer portion of the lower surface when the flexure is not being flexed.

9. The retaining ring of claim 8, wherein the flexure is thinner than the inner section and the outer section.

10. The retaining ring of claim 8, wherein the flexure is composed of the same material as the inner section and the outer section.

11. The retaining ring of claim 10, wherein the retaining ring is a single unitary body of homogenous composition.

12. The retaining ring of claim 8, wherein the inner section is taller than the outer section.

13. The retaining ring of claim 8, wherein the inner section is narrower than the outer section.

14. The retaining ring of claim 8, wherein the inner portion of the lower surface and the outer portion of the lower surface are coplanar.

15. A retaining ring, comprising:

an inner section having a bottom that provides an inner portion of a lower surface of the retaining ring configured to contact a polishing pad, the inner section further having an inner surface extending upwardly from an inner edge of the lower surface and configured to circumferentially surround a substrate mounting surface;

an outer section that is narrower than the inner section and has a bottom that provides an outer portion of the lower surface, the outer section further having an outer surface extending upwardly from an outer edge of the lower surface; and a horizontal flexure that spans an entire gap between the inner section and the outer section and coupling the inner section and the outer section such that the inner section is vertically movable relative to the outer section, wherein a bottom of the flexure provides a middle portion of the lower surface and the inner portion, middle portion, and the outer portion of the lower surface are coplanar when the flexure is not being flexed.

* * * * *